US011857007B1

(12) United States Patent
Dew

(10) Patent No.: US 11,857,007 B1
(45) Date of Patent: Jan. 2, 2024

(54) GRILL KILT

(71) Applicant: J. Yates Dew, Charleston, SC (US)

(72) Inventor: J. Yates Dew, Charleston, SC (US)

(73) Assignee: GRILLKILT, LLC, Charleston, SC (US)

( * ) Notice: Subject to any disclaimer, the term of this patent is extended or adjusted under 35 U.S.C. 154(b) by 219 days.

(21) Appl. No.: 17/447,133

(22) Filed: Sep. 8, 2021

(51) Int. Cl.
*A41D 13/04* (2006.01)
*A41D 13/00* (2006.01)

(52) U.S. Cl.
CPC ..... *A41D 13/04* (2013.01); *A41D 13/0012* (2013.01)

(58) Field of Classification Search
CPC .. A41D 13/04; A41D 13/043; A41D 13/0525; A41D 13/046; A41D 13/0506; A41D 13/0537; A41D 13/055–13/0562; A41D 13/0568; A41D 1/14; A41D 13/0012; A41D 13/02; A41D 15/00; A41D 15/02; A41D 17/00; A41D 17/005; A41D 2200/10; A45F 2003/003; A45F 3/005; A45F 4/00; A45F 4/12; A45F 5/021; A45F 5/02
USPC ..... 2/48, 211, 51, 47, 464–467
See application file for complete search history.

(56) References Cited

U.S. PATENT DOCUMENTS 1,104,185 A * 7/1914 George ..... A41D 1/14 2/211
1,247,779 A * 11/1917 Leonard ..... A41D 15/02 2/213
1,396,203 A * 11/1921 Heinrich ..... A41D 15/02 2/212
1,620,426 A * 3/1927 Baxter ..... A41D 13/04 604/386
1,704,504 A * 3/1929 Hedden ..... A41D 13/04 2/69
2,483,136 A * 9/1949 Hamman ..... A41D 17/02 D2/742
2,648,845 A * 8/1953 Berman ..... A41B 13/10 2/48
2,683,880 A * 7/1954 Krigbaum ..... A41D 13/04 2/48
3,601,815 A * 8/1971 Strehlan ..... A41D 13/04 2/48
3,797,043 A * 3/1974 Brument ..... A41D 15/04 2/69.5
3,859,667 A * 1/1975 Roy ..... A41D 1/14 2/212
(Continued)

FOREIGN PATENT DOCUMENTS

CA 2268205 A1 * 8/2000 ..... A45F 5/021
FR 1247420 A * 12/1960
(Continued)

*Primary Examiner* — Amy Vanatta
(74) *Attorney, Agent, or Firm* — Tuggle Duggins P.A.; Blake P. Hurt

(57) ABSTRACT

An adjustable garment in the style of an apron configured to protect clothing during grilling and provides accessibility to utensils, accessories, and other items desired for grilling. The garment is formed from a belt and a skirt having a first panel and one or more detachable second panel(s). The first panel includes one or more pockets sized and shaped to receive a range of grilling accessories. The diameter of the skirt may be adjusted by adding or removing one or more of the detachable second panel(s) and the belt fastens at the back with a buckle.

15 Claims, 7 Drawing Sheets

(56) References Cited

U.S. PATENT DOCUMENTS

| | | | | |
|---|---|---|---|---|
| 4,986,459 | A * | 1/1991 | Yarbrough, Jr. | A45F 5/14 224/195 |
| 5,327,586 | A * | 7/1994 | Evans | A41D 1/14 2/48 |
| 5,943,696 | A * | 8/1999 | Walker | B44D 3/14 224/904 |
| 7,320,421 | B2 * | 1/2008 | Guminski | A01K 29/00 224/268 |
| 7,484,249 | B1 * | 2/2009 | Reese | A41D 27/20 2/48 |
| 2002/0166155 | A1 * | 11/2002 | Katz | A41D 13/065 2/48 |
| 2008/0203127 | A1 * | 8/2008 | Castillo-Garrison | A45F 5/02 224/257 |
| 2010/0122709 | A1 * | 5/2010 | Janatpour | A45F 5/00 132/286 |
| 2012/0090076 | A1 * | 4/2012 | Kenney | A41D 15/02 2/211 |
| 2013/0043286 | A1 * | 2/2013 | Kast | A41D 1/14 224/191 |
| 2017/0020208 | A1 * | 1/2017 | Velie | A41D 13/04 |

FOREIGN PATENT DOCUMENTS

| | | | | |
|---|---|---|---|---|
| FR | 2157126 | A5 * | 6/1973 | |
| GB | 818997 | A * | 8/1959 | A45F 5/021 |

* cited by examiner

GRILL KILT

FIELD OF THE INVENTION

The invention herein pertains to garments generally, and particularly pertains to an adjustable grilling garment in the style of an apron configured to protect a wide range of clothing items worn by a variety of grillers from food spills and to provide accessibility to utensils, accessories, and other items desired for grilling.

DESCRIPTION OF THE PRIOR ART AND OBJECTIVES OF THE INVENTION

Barbecuing and grilling often requires the use of sauce, oil, grease, and food items which may contain fats, oils, or juices that can easy spill or splash during meal preparation. The juices and sauces may cause food staining which is then embedded into clothing items and are oftentimes difficult to remove. Clothing stains can be a hassle especially when entertaining guests during a gathering or function as the stains give off a visually unclean appearance to a person's attire. Barbecuing and grilling also requires the use of towels, gloves, and utensils to assist in meal preparation. Handling several items and tools at one time can become overwhelming and difficult to manage while also monitoring food items on a grill. Grillers may also prefer to engage in drinking or may need easy access to items such as bottle openers, cell phones, flashlights, or lighters while grilling and may prefer to have these items within arm's reach at all times. While grilling, it becomes a safety hazard to try holding all of these items at once or sitting these items on the grill or within close proximity to the grill. To ensure stress-free grilling, having these items hooked onto or placed within a garment secured around the griller's waist is ideal and efficient.

Past inventions have attempted to address these concerns by providing aprons that cover clothing. These inventions however, do not address accessibility to items such as cooking utensils and do not provide hooks for ease of access to other items. These past inventions also do not protect the back end of clothing and do not provide additional attachments to extend the size of the garment protective surface while maintaining its relative size. No past inventions have provided garments that provide versatility at a cost efficient price.

Thus, in view of the problems and disadvantages associated with prior art, the present invention was conceived and one of its objectives is to provide a garment with versatility and durability during grilling.

It is another objective of the present invention to provide a garment with easy to use functionality.

It is still another objective of the present invention to provide a garment that conveniently has the ability to store and hook needed items.

It is yet another objective of the present invention to provide a garment that contains a detachable top portion.

Another objective of the present invention is to provide a garment in the style of an apron that is formed from a belt that fastens in the back and a skirt with first and second panels that allow the garment to be adjusted by adding or removing one or more detachable second panel(s).

In another objective of the present invention, the garment's belt includes one or more D-ring(s) with one or more clip(s) that hold utensils, accessories, and other items desired for grilling such as hand towels, flashlights, and bottle openers.

It is another objective of the present invention to provide a garment with a first panel with an internal and external surface with the belt affixed to the external surface and a loop strip carried on the internal surface, while the first panel includes one or more pockets sized and shaped to receive a range of grilling accessories.

Various other objectives and advantages of the present invention will become apparent to those skilled in the art as a more detailed description is set forth below.

SUMMARY OF THE INVENTION

An adjustable garment in the style of an apron formed from a belt and a skirt, the skirt including a first panel and one or more detachable second panel(s). The first panel defines internal and external surfaces with the belt affixed to the external surface and a loop strip carried on the internal surface. The first panel includes one or more pockets sized and shaped to receive one or more grilling accessories therein. Each of the detachable second panel(s) include front and back surfaces, the front surface carrying a strip of hook material and the back surface carrying a strip of loop material. The one or more detachable second panel(s) are releasably attached to one or both of the belt and first panel(s) via the second panel hook and loop strips, respectively. The diameter of the skirt may be adjusted by adding or removing one or more of the detachable second panel(s) and the belt fastens at the back with a buckle. The apron is configured to protect a wide range of clothing items worn by a variety of grillers from food spills and to provide accessibility to utensils, accessories, and other items desired for grilling.

DETAILED DESCRIPTION OF THE PREFERRED EMBODIMENT AND OPERATION OF THE INVENTION

Figure 1:
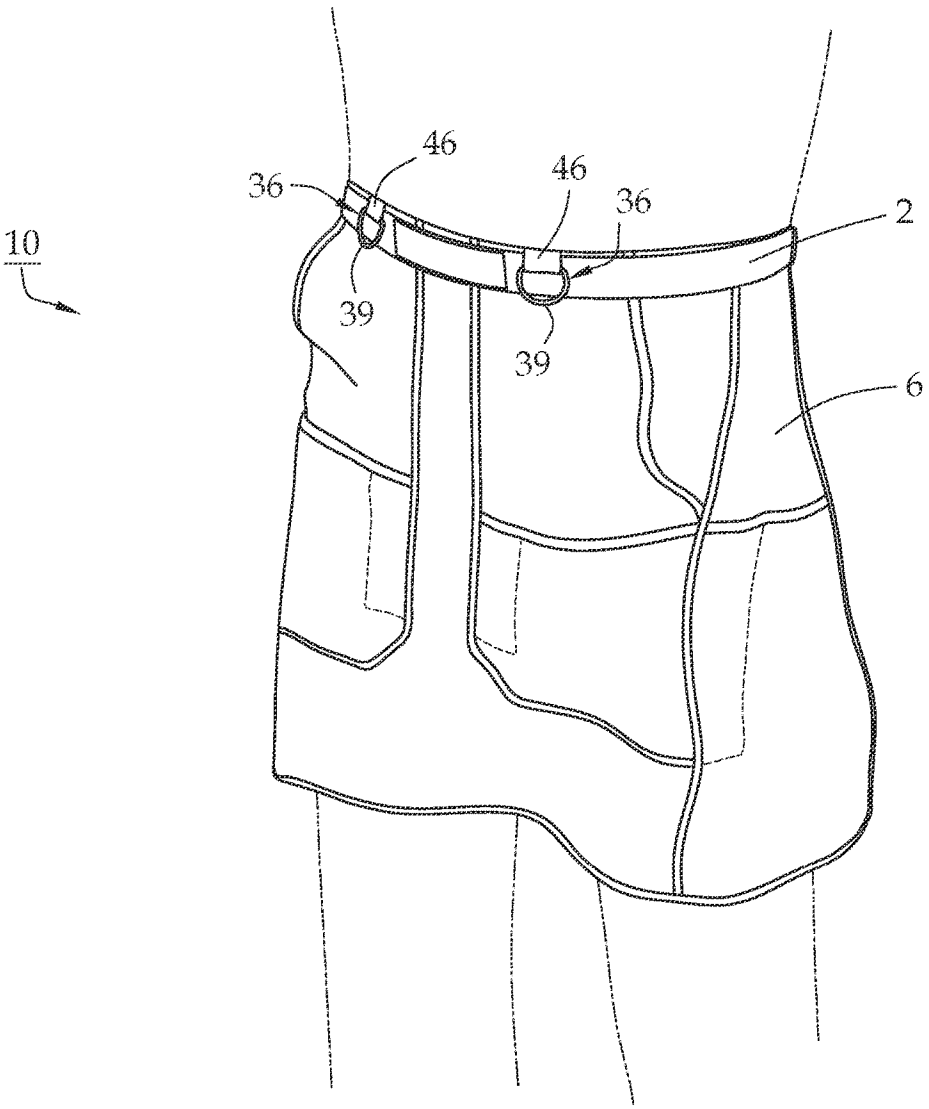
FIG. 1 shows the garment as worn on an individual.

Various exemplary embodiments of the present disclosure are described below. Use of the term "exemplary" means illustrative or by way of example only, and any reference herein to "the invention" is not intended to restrict or limit the invention to exact features or step of any one or more of the exemplary embodiments disclosed in the present specification. References to "exemplary embodiment", "one embodiment", "an embodiment", "various embodiments", and the like may indicate that the embodiment(s) of the invention so described may include a particular feature, structure, or characteristic, but not every embodiment necessarily incudes the particular feature, structure, or characteristic. Further, repeated use of the phrase "in one embodiment", "in an exemplary embodiment", or "in an alternative embodiment" do not necessarily refer to the same embodiment, although they may.

It is also noted that terms like "preferably", "commonly", and "typically" are not utilized herein to limit the scope of the invention or to imply that certain features are critical, essential, or even important to the structure or function of the invention. Rather, these terms are merely intended to highlight alternative or additional features that may or may not be utilized in a particular embodiment of the present invention.

The present invention is described more fully hereinafter with reference to the accompanying figures, in which one or more exemplary embodiments of the invention are shown. Like numbers used herein refer to like elements throughout. The invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limited as to the scope of the invention, and any and all equivalents thereof. Moreover, many embodiments such as adaptations, variations, modifications, and equivalent arrangements will be implicitly disclosed by the embodiments described herein and fall within the scope of the instant invention.

Although specific terms are employed herein, they are used in a generic and descriptive sense only and not for the purposes of limitation. Unless otherwise expressly defined herein, such terms are intended to be given their broad, ordinary, and customary meaning not inconsistent with that applicable in the relevant industry ad without restriction to any specific embodiment hereinafter described. As used herein, the article "a" is intended to include one or more items. Where only one item is intended, the terms "one and only one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has previously been reduced to practice or that any testing has been performed. Likewise, unless stated otherwise, use of verbs in the past tense (present perfect or preterit) is not intended to indicate or imply that the invention has previously been reduced to practice or that any testing has been performed.

For a better understanding of the invention and its operation, turning now to the drawings, FIGS. 1-7 illustrate the preferred embodiment for garment 10. Throughout the description and illustrations, garment 10 is represented as an adjustable garment in the style of an apron, preferably defining a belt 2 and a skirt 6; the skirt 6 including a first panel 8 and one or more detachable second panel(s) 20. Garment 10 is configured to protect clothing worn by a variety of grillers from food spills and splatters while providing accessibility to utensils, accessories, and other items desired for grilling. The diameter and coverage of skirt 6 may be adjusted by adding or removing one or more of the detachable second panel(s) 20 and the belt 2 fastens at the back by use of a belt fastener 4 such as for example a side release strap adjustable buckle, clasp, clip, or the like.

In the preferred embodiment, skirt 6 comprises a first panel 8 and potentially one or more detachable second panel(s) 20. Skirt 6 is preferably formed from cotton material but may be formed from other durable, breathable and/or washable fabric(s) and/or synthetic material(s). It is a preference for the color of skirt 6 to be of a dark hue such as black, dark green, or grey to hide moisture and stains, but these colors are not to be construed as a limitation of the current invention. First panel 8 is a single article configured along with the belt 2, to wrap around a person's 360 degree waist. First panel 8 preferably defines a trapezoidal shape measuring approximately twenty-eight inches at the top (i.e. the portion closest to belt 2), thirty-six inches at the bottom (i.e. the portion opposing the top portion), and a length of twenty inches permanently or releasably affixed to belt 2 which circumscribes a 360 degree waist. It is a preference for first panel 8 to define an internal surface 14 and an external surface 18, wherein the belt 2 is affixed to the external surface 18 and a loop attachment strip 30 is securely attached to the internal surface 14. The belt 2 and loop attachment strip 30 may be securely attached by methods that may include taping, sewing, gluing, wiring, wedging, or by hooking and looping, however it is a preference to sew the belt 2 to the external surface 18 and to sew the loop attachment strip 30 to the internal surface 14.

Figure 2:
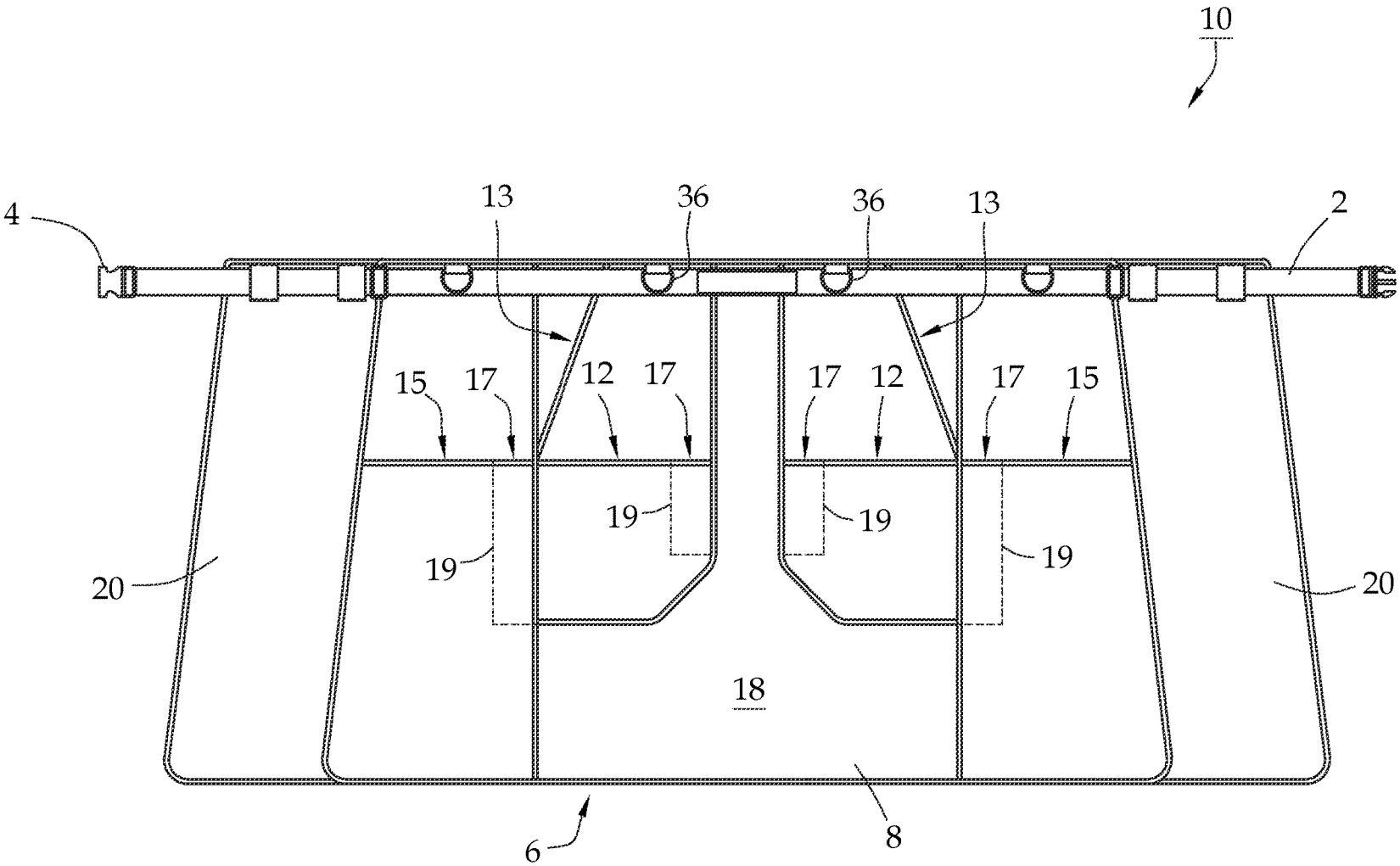
FIG. 2 pictures an elevated front view of the garment of FIG. 1 unfastened from the individual.
Figure 3:
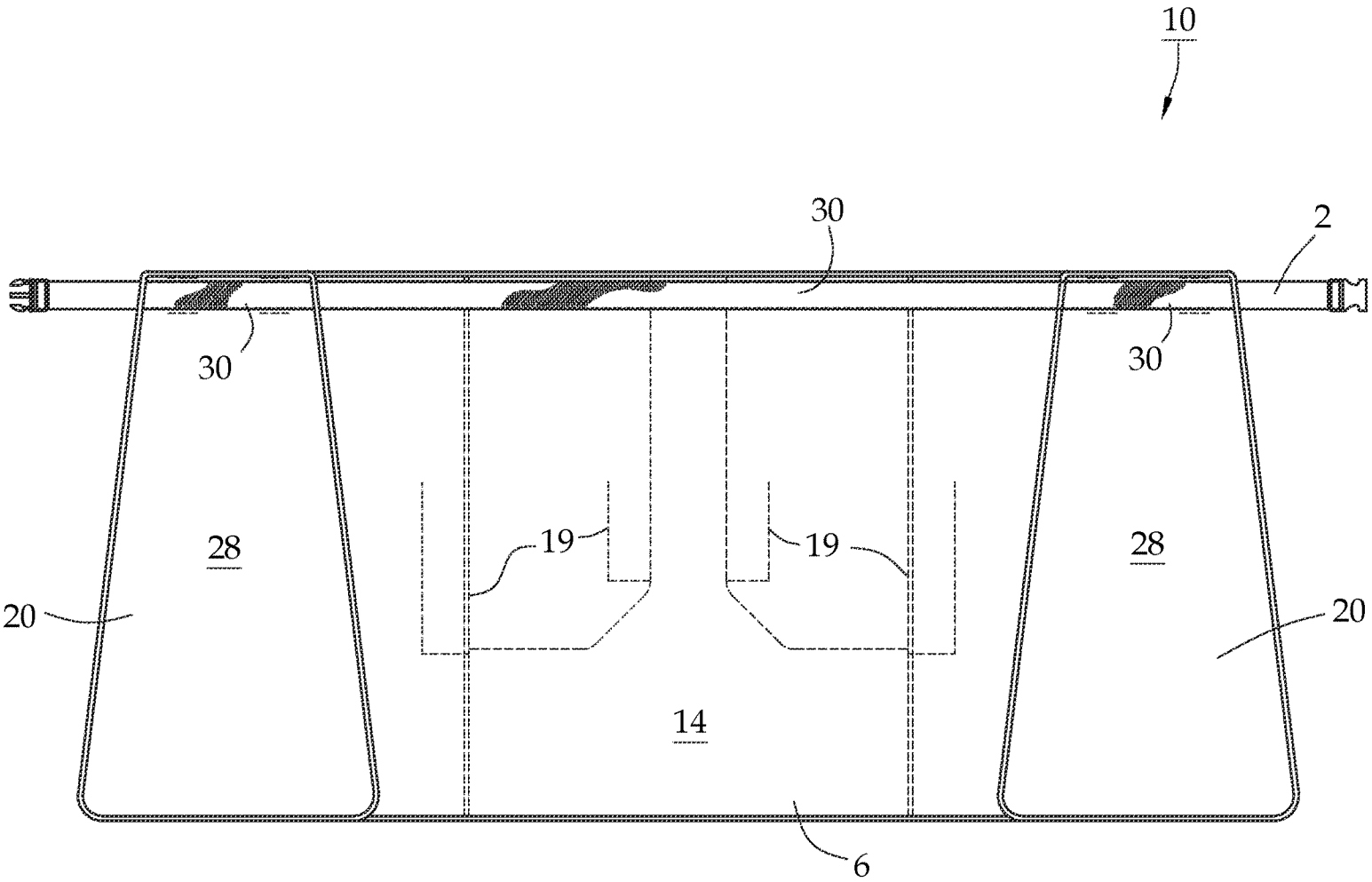
FIG. 3 depicts an elevated rear view of the garment of FIG. 2.
Figure 4:
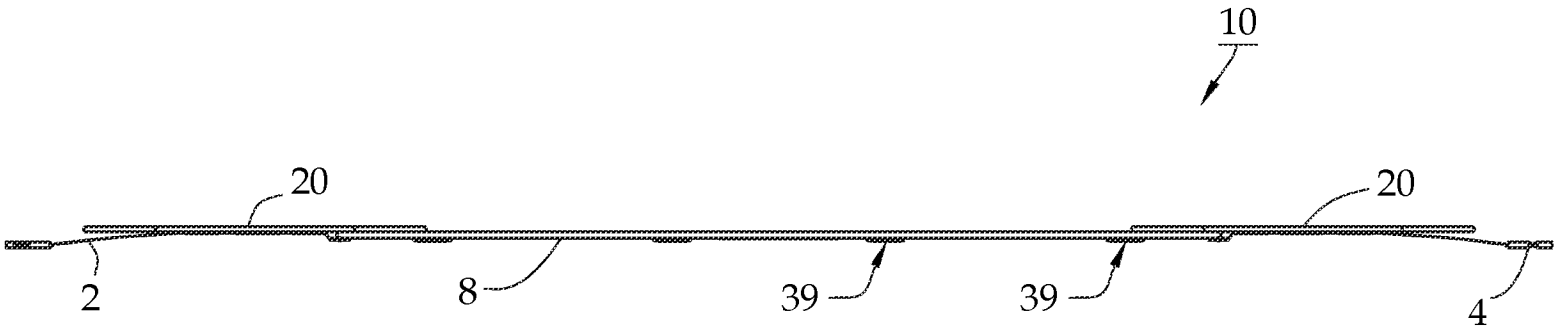
FIG. 4 demonstrates a bottom plan view of the garment of FIG. 2.
Figure 5:
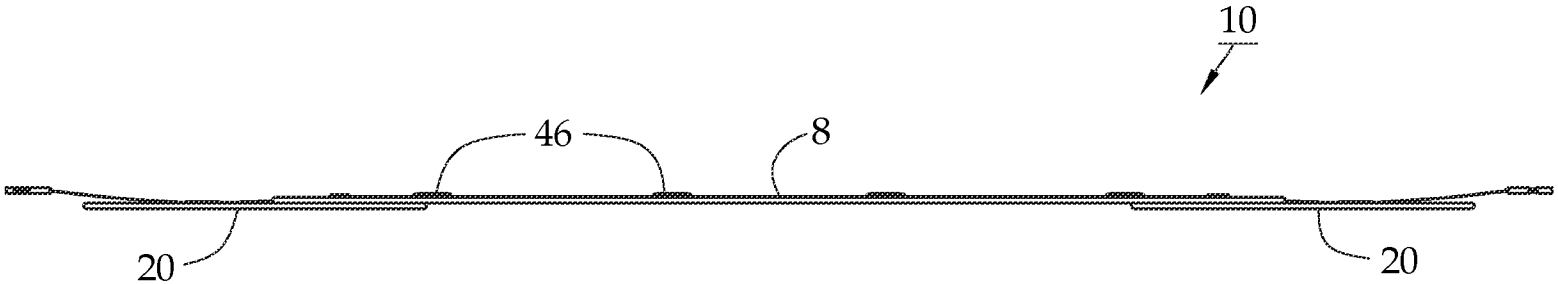
FIG. 5 illustrates a top plan view of the garment of FIG. 2.
Figure 7:
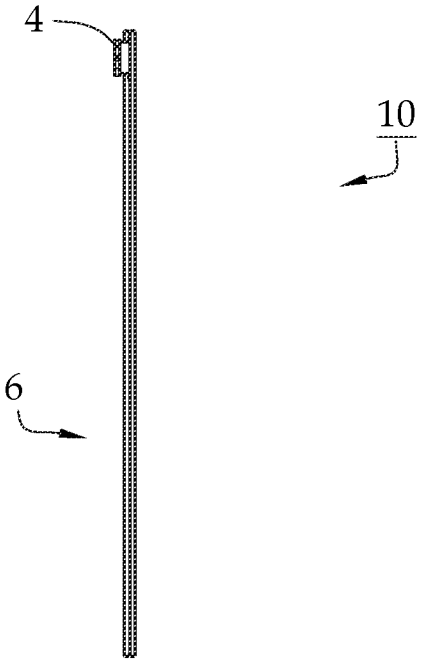
FIG. 7 shows a left side view of the detachable panel of FIG. 6.
Figure 6:
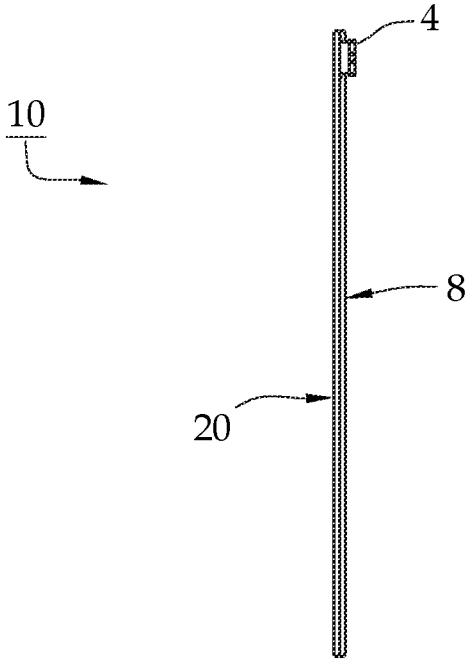
FIG. 6 features a right side view of a detachable panel of the garment of FIG. 2.

In the preferred embodiment, first panel 8 also contains one or more pocket(s) 12 which are securely attached to the first panel 8. Although sewing is the preferred method of attachment, the pocket(s) 12 may be attached to the first panel 8 by taping, sewing, gluing, wiring, wedging, hooking and looping, or by other forms of attachment. The preferred embodiment contains two large pockets 13, at least one pocket 12 attached to each of the two large pockets 13, and two hip pockets 15 on both sides of the first panel 8, totaling six pockets. Further included are elongated smaller pockets 17 defined by stitching 19 within pockets 12, and hip pockets 15 as seen in FIGS. 2 and 3. The inclusion, size, shape, and/or positioning of one or more pockets is not to be construed as a limitation of the present invention.

In the preferred embodiment, the one or more detachable second panel(s) 20 comprise a front surface 22 and a back surface 28. The front surface 22 comprises a hook attachment strip 24 and one or more belt loop(s) 26 for receipt of the belt 2. It is a preference for the hook attachment strip 24 to be sewn onto the front surface 22 but other methods of attachment such as taping, gluing, wiring, wedging, or hooking and looping may also be used. It is also a preference for the belt loop(s) 26 to be formed from hook attachment material and for the belt loop(s) 26 to bridge over the hook attachment strip 24. There are two belt loops 26 on each detachable second panel 20 in the preferred embodiment. Additionally, the back surface 28 comprises a loop attachment strip 30. Though first panel 8 provides fabric coverage as previously described, and in combination with belt 2 circumscribes a 360 degree waist, the insertion of one or more detachable second panel(s) 20 may increase the fabric coverage up to twelve inches of extra waist width (per panel 20) as measured along the length of belt 2, thereby increasing the fabric coverage afforded the wearer. Additionally, the one or more detachable second panel(s) 20 are attached to one or more of the belt 2 and the first panel 8 by way of the hook attachment strip 24 and one or more belt loop(s) 26 on the front surface 22 of the one or more detachable second panel(s) 20. In one embodiment, the one or more detachable second panels preferably define a trapezoidal shape measuring approximately nine inches at the top (i.e. the portion closest to belt 2), twelve inches at the bottom (i.e. the portion opposing the top portion), and a length of twenty inches releasably affixed to belt 2 which circumscribes a 360 degree waist.

In the preferred embodiment, belt 2 is formed from durable fabric such as nylon or polypropylene webbing. Belt 2 is preferably sewn to first panel 8, however belt 2 may be securely attached to the first panel 8 by other methods that may include taping, sewing, gluing, wiring, wedging, or by hooking and looping. Belt 2 preferably comprises one or more D-ring(s) 36 and a belt fastener 4. It is a preference for the D-ring(s) 36 to be formed from metal or stainless steel, however the D-ring(s) 36 may also be formed from plastic, zinc die cast, solid brass, or other durable material. The D-ring(s) 36 are shaped like a D with a curved side 39. The D-ring(s) 36 are attached to the belt 2 preferably by sewing a small fabric hook 46 to the belt 2 by looping the fabric hook 46 around the straight side of the D-ring and riveting or sewing the fabric hook 46 to itself. The D-Ring(s) 36 provide less movement as added attachments on the flat side are unable to swivel as freely around the D-ring 36. Though the preferred method of attaching the D-ring to the belt and fabric hook 46 is by sewing, other methods may include taping, sewing, gluing, wiring, wedging, or hooking and looping.

Figure 8:
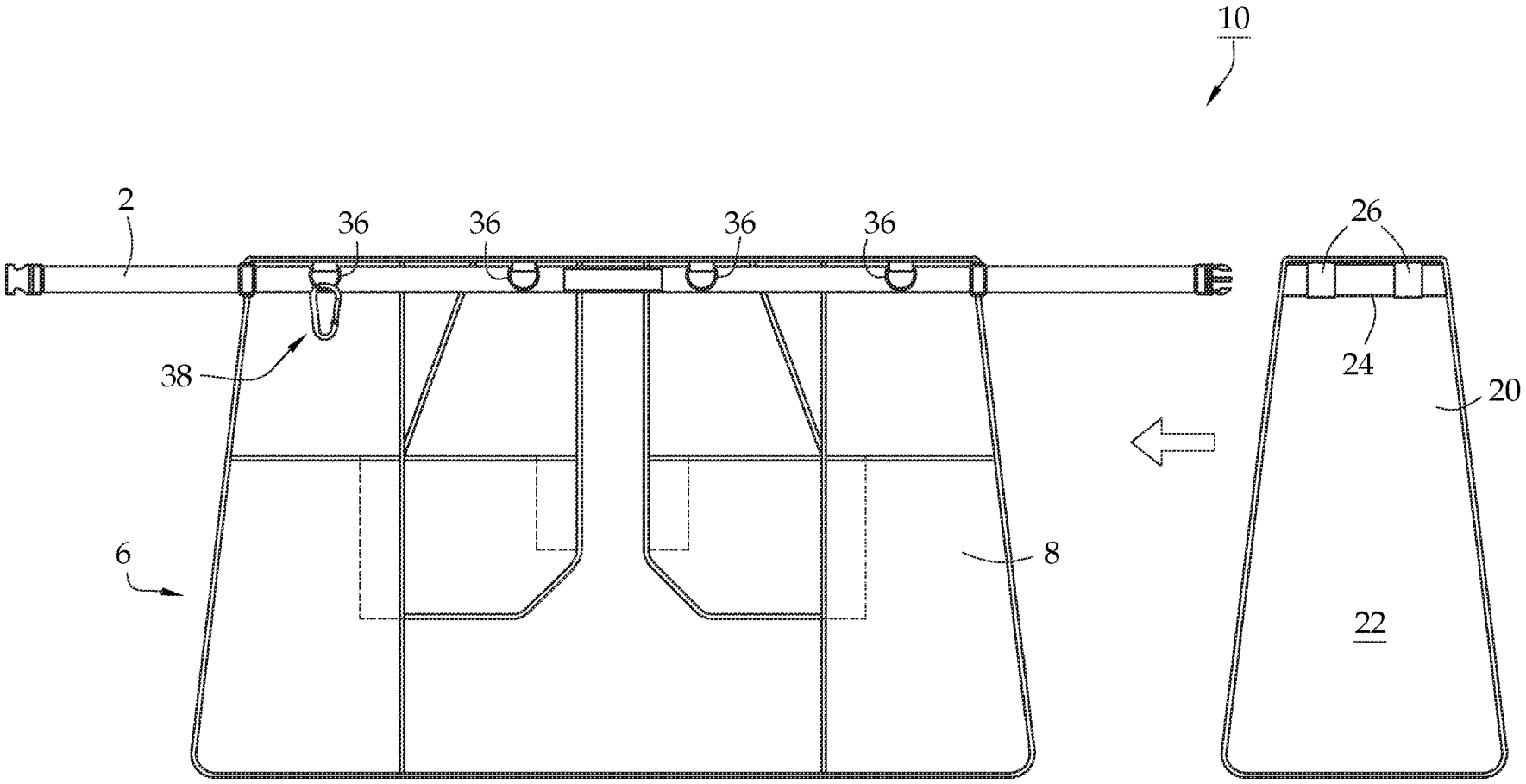
FIG. 8 illustrates a front schematic view of the garment of FIG. 1 unfastened and one of the detachable panels of FIG. 2 removed from the garment.

It is a preference for another strap or piece of hardware such as a clip 38 to be attached to the curved side 39 of the D-ring 36. The preferred embodiment includes five D-rings 36, five fabric hooks 46, and five clips 38, though the inclusion, size, shape, and positioning are not to be considered a limitation of the current invention. The clip(s) 38 are preferably formed from aluminum but may be formed from other durable material such as other metal(s) or plastic. It is also a preference for the clip(s) 38 to be D-style snap clips or mini-carabiner clips such as seen in FIG. 8, though such is not to be considered a limitation. The one or more clip(s) 38 may further include accessories, and other items desired for grilling such as for example a detachable hand towel 40, a flashlight 42, and a bottle opener 46. The detachable hand towel 40 preferably includes a center grommet for ease of clipping. The detachable hand towel 40 in the preferred embodiment is also formed from 100% cotton, is tri-fold, and is preferable a dark color such as black. This however is not to be construed as a limitation of the present disclosure. The bottle opener 46 defines a dual bottle opener and clip ideal for opening beverages and clipping grilling accessories to the garment 10.

Figure 9:
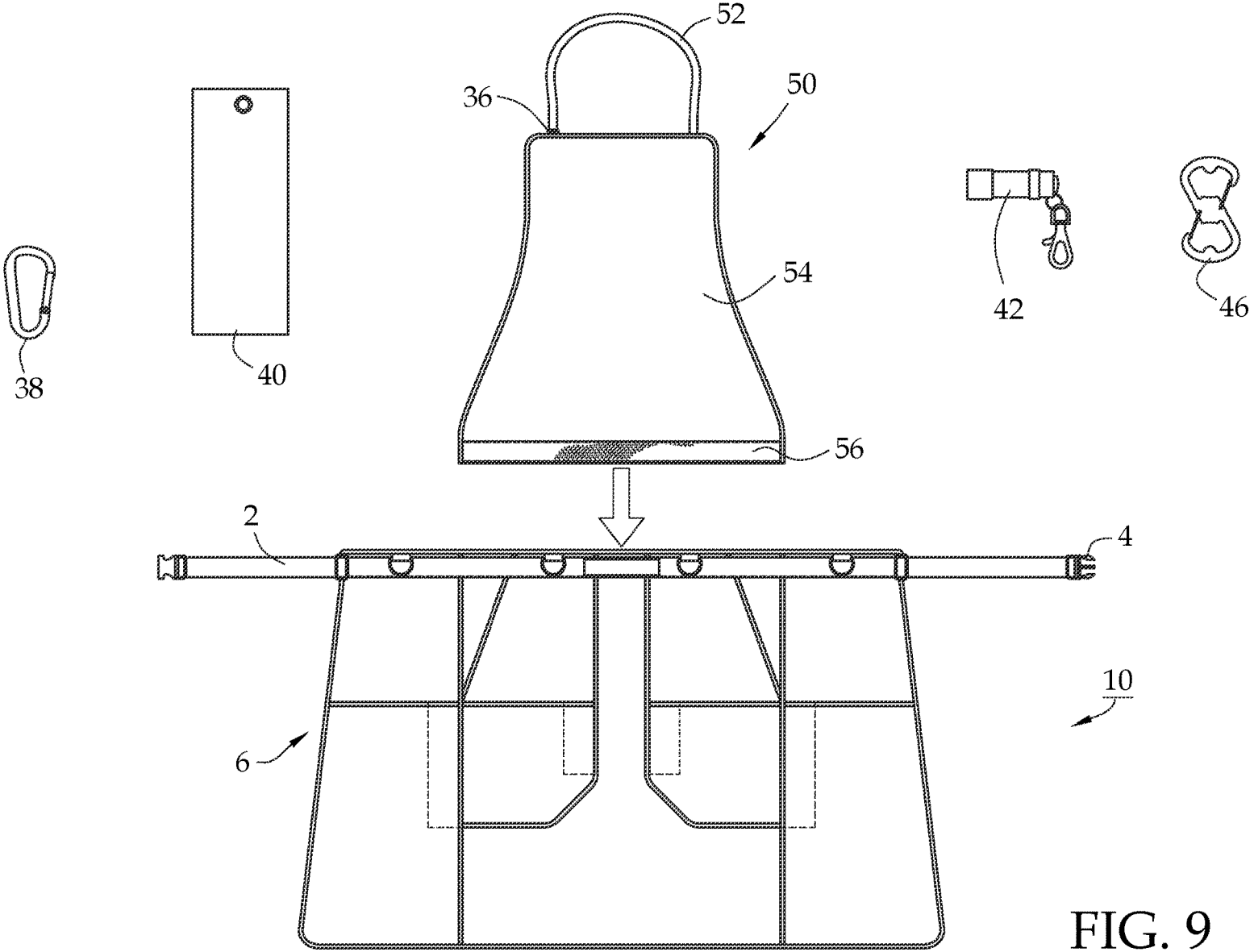
FIG. 9 depicts a front view of an alternative embodiment of the garment unfastened and the removable top portion displayed above the garment.

A second embodiment of garment 10 further includes a removable top portion 50 comprising a neck loop 52 and a bib 54 as seen in FIG. 9. The removable top portion 50 is formed from cotton material but may be formed from other durable, breathable and washable fabric material. It is a preference for the color of removable top portion 50 to match that of the skirt 6, however this is not to be construed as a limitation of the current invention. The neck loop 52 is a thin strap of material and is adjustable by use of a D-ring 36 which is positioned at the bottom corner where the neck loop 52 and bib 54 join. The bib 54 should be positioned on the chest of the griller and can be securely attached to the skirt 6 by affixing hook strip 56 along the bottom thereof to loop strip 30 of internal surface 14.

The illustrations and examples provided herein are for explanatory purposes and are not intended to limit the scope of the appended claims.

I claim:

1. A garment comprising:

a belt; and a skirt comprising a first panel and one or more detachable second panel(s), the one or more detachable second panel(s) further comprise(s) a front surface and a back surface, the front surface comprising a hook attachment strip and one or more belt loop(s) for receipt of the belt, the back surface further comprising a loop attachment strip, the one or more detachable second panel(s) removably attached to one or more of the belt and the first panel, wherein the belt size is adjustable by adding or removing more or less detachable second panel(s).

2. The garment of claim 1, further comprising a removable top portion.

3. The garment of claim 1, wherein the first panel defines internal and external surfaces, wherein the belt is affixed to the external surface, and the internal surface comprises a loop attachment strip.

4. The garment of claim 1, wherein the one or more detachable second panel(s) are attached to the belt and the first panel by way of the hook attachment strip and one or more belt loop(s) on the front surface of the one or more detachable second panel(s).

5. The garment of claim 1, wherein the belt loop(s) bridge the hook attachment strip and the belt loop(s) is/are formed from hook attachment material.

6. The garment of claim 1, wherein the first panel of the skirt comprises one or more pocket(s).

7. The garment of claim 1, wherein the belt further comprises a belt fastener.

8. The garment of claim 1, wherein the belt further comprises one or more D-ring(s).

9. The garment of claim 8, wherein the one or more D-ring(s) comprise(s) one or more clip(s).

10. The garment of claim 9, wherein the one or more clip(s) comprise(s) a hand towel.

11. The garment of claim 10, wherein the one or more clip(s) comprise(s) a flashlight.

12. The garment of claim 11, wherein the one or more clip(s) comprise(s) a bottle opener.

13. The garment of claim 1, wherein the insertion of one or more detachable second panel(s) provides up to twelve inches of additional waist length measured along the belt.

14. A garment comprising:

a belt comprising one or more D-ring(s) and a belt fastener, the one or more D-ring(s) further comprising one or more clip(s), the one or more clip(s) further comprising a detachable hand towel, a flashlight, and a bottle opener;

a removable top portion comprising a neck loop and a bib, the neck loop further comprising a D-ring; and a skirt comprising a first panel and one or more detachable second panel(s), the first panel defining internal and external surfaces, wherein the belt is affixed to the external surface and the internal surface comprising a loop attachment strip, the one or more detachable second panel(s) comprising a front surface and a back surface, the front surface comprising a hook attachment strip and one or more belt loop(s) for receipt of the belt, the belt loop(s) bridging the hook attachment strip, the belt loop formed from hook attachment material, the back surface comprising a loop attachment strip, the one or more detachable second panel(s) attached to the belt and the first panel by way of the hook attachment strip and one or more belt loop(s) on the front surface of the one or more detachable second panel(s), wherein the belt size is adjustable by adding or removing more or less detachable second panel(s).

15. The garment of claim 14, wherein the insertion of one or more detachable second panel(s) provides up to twelve inches of additional waist coverage.

* * * * *